US005791623A

United States Patent [19]

Louridas

[11] Patent Number: 5,791,623

[45] Date of Patent: Aug. 11, 1998

[54] EASEL MOUNTING DEVICE

[76] Inventor: Michael C. Louridas, 6220 N. 8th St., Philadelphia, Pa. 19126

[21] Appl. No.: 871,285

[22] Filed: Jun. 9, 1997

Related U.S. Application Data

[63] Continuation of Ser. No. 399,651, Mar. 7, 1995, abandoned.

[51] Int. Cl.[6] ..... A47B 97/04

[52] U.S. Cl. ..... 248/451; 248/449; 248/168; 248/178.1

[58] Field of Search ..... 248/447, 448, 248/449, 450, 451, 452, 453, 457, 458, 460, 464, 168, 177.1, 178.1

[56] References Cited

U.S. PATENT DOCUMENTS

| | | | |
|---|---|---|---|
| 664,664 | 12/1900 | Montgomery | 248/452 |
| 751,408 | 2/1904 | Pettit | 248/452 |
| 884,722 | 4/1908 | Davis | 248/452 |
| 1,275,929 | 8/1918 | Hyder | 248/457 |
| 1,782,118 | 11/1930 | Cahall | 248/449 |
| 2,568,354 | 9/1951 | Moore | 248/448 |
| 2,729,018 | 1/1956 | Morgan | 248/448 |
| 2,984,443 | 5/1961 | Bergengren | 248/451 X |
| 3,122,858 | 3/1964 | Kadin | 248/449 |
| 3,228,360 | 1/1966 | Jones | 248/178.1 X |
| 3,738,606 | 6/1973 | Millen | 248/449 |
| 3,813,075 | 5/1974 | Capper | 248/451 X |
| 3,899,164 | 8/1975 | Newman | 248/451 X |
| 4,042,203 | 8/1977 | Warkentin | 248/449 |
| 4,165,856 | 8/1979 | Wiseheart | 248/458 X |
| 4,448,384 | 5/1984 | Jones, Jr. et al. | 248/448 X |
| 4,690,363 | 9/1987 | Kones | 248/449 |
| 5,074,513 | 12/1991 | Presley et al. | 248/458 X |
| 5,205,526 | 4/1993 | Duetsch | 248/464 X |
| 5,219,142 | 6/1993 | Potter | 248/460 X |
| 5,242,145 | 9/1993 | Linnell | 248/460 X |
| 5,624,097 | 4/1997 | Potter | 248/451 X |

*Primary Examiner*—Ramon O. Ramirez
*Assistant Examiner*—Stephen S. Wentsler
*Attorney, Agent, or Firm*—Eugene E. Renz, P.C.

[57] ABSTRACT

An easel and a camera tripod in combination where the camera tripod has a universal mounting plate, the position of which is adjustable. The combination also includes an easel having a central carriage bracket for attachment to the camera tripod, a top and bottom bracket each having a surface for engaging a canvas or other planar medium. The easel includes a plurality of pairs of extension rods, one pair of which is adjustably fastened to the carriage bracket and the top bracket and another pair of which is adjustably fastened to the carriage bracket and the bottom bracket to thereby define a canvas support plane engaging the undersurface of the canvas. The top and bottom brackets engage opposing sides of a canvas. At least one of the top and bottom brackets includes a pressure knob for adjustably engaging the canvas side. One pair or both pairs of extension rods includes a second pair of extension rods removably attached to each respective pair to extend the length between the respective top or bottom bracket and the carriage bracket to extending the distances therebetween. The extension rods are adjustably mounted to their respective blocks by threaded knobs mounted thereon. The tripod includes a universal mounting plate and at least one threaded attachment screw for attachment to the camera tripod. Locking elements are provided for supporting the mounting plate at a predetermined position on the carriage block.

3 Claims, 8 Drawing Sheets

EASEL MOUNTING DEVICE

This application is a continuation, of application Ser. No. 08/399,651, filed Mar. 7, 1995, now abandoned.

FIELD OF THE INVENTION

The present invention relates to an easel for mounting diverse sizes and types of artist's canvases and the like. More particularly, this invention relates to an easel for use with a conventional camera tripod, whereby the easel is adapted to position oil canvas, watercolor board, gesso prepared masonite, copy board, artistic media and other planar objects in a variety of horizontal or vertical orientations and positions.

BACKGROUND OF THE INVENTION

Artists working in a studio normally have the luxury of having a plurality of easels, tripods and other fixtures for mounting, displaying and working with planar surface objects such as artist's canvases and the like. Even then, however, space is not unlimited and it is desirable to have access to the ongoing work without having cluttered and overcrowded conditions detracting from the workplace. For that reason it is desirable to have an easel that will accommodate a wide variety of the work of a particular artist.

In some instances an artist will work in different media, such as oil paint and watercolor, for example. Other times the artist will be working with a number of canvases, perhaps of different sizes or shapes. Most often an artist working in the studio will have all of the peripheral equipment needed in a convenient and organized location so that work can proceed most efficiently. It is particularly important to eliminate distractions and delays that might have an adverse effect on the creative process. For that reason, artists in studios prefer to use the same easel for successive projects, rather than rearrange or substitute working materials as each new project comes into existence. At the present time, however, there is no universal easel available that would permit the artist to work on a plurality of successive projects of different sizes, shapes and configurations.

Another problem that exists for artists and others who use easels is the difficulty of taking the easel to remote locations away from the studio or normal place of work. If the artist is going to work indoors at another location, the easel that is provided may or may not conform to the one the artist has become accustomed to using. It also may or may not be of the right size and configuration for the particular project currently of interest. If the work is to be done outdoors, of course, the problem is even worse as many easels are unsuited for use on uneven terrain. The need to carry more than one easel is an unneeded burden and prevents effective work in the field without excessive preparation or difficulty.

In today's market there are some light weight aluminum easels, but they are flimsy and have limited use. One difficulty is that these light weight easels are unable to support the weight of a heavy working surface. They are also limited in the degree of freedom of movement for positioning the canvas or the like. Wooden easels, such as those manufactured in France, are very fragile and difficult to set up in the field. The legs easily break or crack if accidentally hit or dropped. There are other easels made from aluminum that have shown the drawback of developing burs and jamming when opened or folded down for transport. All of the prior art easels lack the ability and versatility to hold large size canvases and don't support the weight of major working surfaces. Moreover, prior art easels lack the movements that watercolorists require, forcing artists using that medium to use additional support structures.

Accordingly, it is an object of this invention to provide an easel that is universal in application, allowing the artist to work in any medium using the same easel.

Another object is to provide an easel that properly supports canvases in an upright orientation and also will accommodate watercolor board in the horizontal orientation.

Yet another object of this invention is to provide an inexpensive and effective easel that can be used with existing equipment, particularly with camera tripods of conventional design.

Still another object of this invention is to provide an easel that is easily stored and transported yet is expandable to accommodate large canvases and boards.

Other objects will appear hereinafter.

SUMMARY OF THE INVENTION

It has now been discovered that the above and other objects of the present invention may be accomplished in the following manner. Specifically, an improved easel for supporting a canvas and the like for use with a camera tripod has been discovered.

The easel which may be made from metal, plastic, wood or other materials, includes a central carriage bracket having means for attachment to a camera tripod, a top bracket having a downward facing canvas engaging surface, and a bottom bracket having an upward facing canvas engaging surface.

Also included is a plurality of pairs of extension rods, one pair of which is adjustably fastened to said carriage bracket and said top bracket and another pair of which is adjustably fastened to said carriage bracket and said bottom bracket, to thereby define a canvas support plane in which said top and bottom brackets engage opposing sides of a canvas and the carriage bracket engages the undersurface of said canvas.

At least one of the top and bottom brackets includes a pressure knob for adjustably engaging the side of the canvas to secure it firmly to the easel. Preferably both the top and bottom brackets have such pressure knobs, although only one will normally have to be adjusted to firmly mount the canvas or other planar object to the easel.

At least one or the other of the pairs of extension rods includes a second pair of extension rods removably attached to them to extend the length between said top bracket and said carriage bracket. The pairs of extension rods are adjustably mounted to their respective blocks by threaded knob means mounted thereon.

The tripod includes a universal mounting plate and at least one threaded attachment screw. The carriage bracket includes a threaded hole for alignment with the threaded attachment screw on the tripod. The mounting plate is attached to the carriage plate more firmly by use of locking disks that support the mounting plate at a predetermined position on the carriage block. Preferably, the locking disk means includes a pair of eccentric disks mounted to the carriage block for secure engagement with the mounting plate. The locking disk means may also include an added slide locking device to assist in securing larger tripod heads to the device of this invention. Finally, the easel includes means for storing additional pairs of extension rods in addition to said one pair, said other pair, and said second pairs of extension rods, whereby the desired size of said easel is determined by selection of specific sizes of pairs of extension rods.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
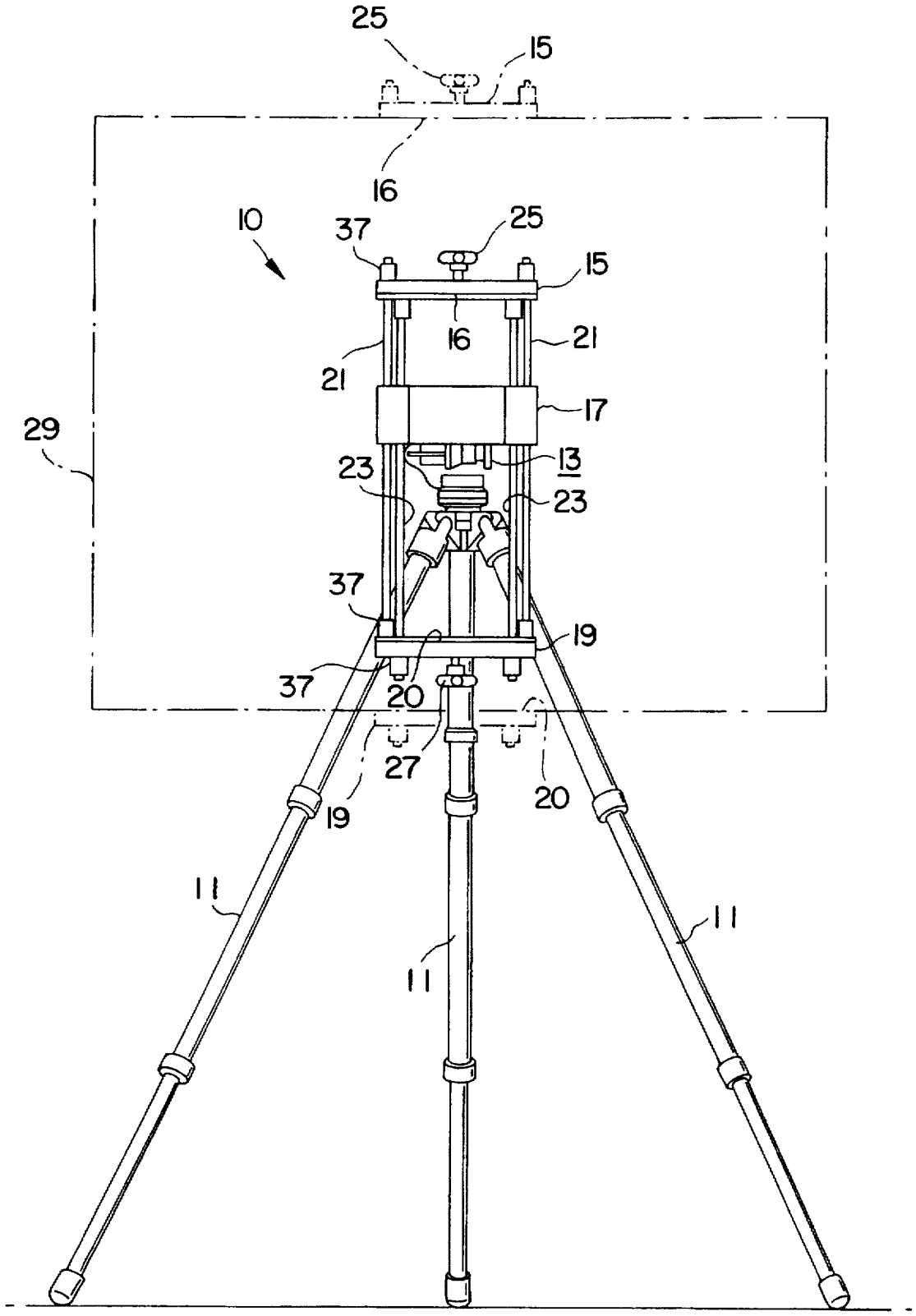
FIG. 1 is a schematic, front elevational view of the invention, shown in this embodiment in an oil painting mode with the clamping frame shown in full line in its most retracted position and with the clamping frame in its most extended position, retaining a large canvas in the dot and dash line.

As shown in the drawings, the preferred easel and camera tripod assembly is shown generally by the reference number 10. The tripod includes three telescoping legs 11, of conventional design and adapted to position the assembly on a variety of surfaces as tripods are designed to do. The camera tripod is of conventional design and includes a mounting element 13 generally for attachment of cameras and other photography equipment such as meters, lights and the like to the tripod.

The easel of this invention includes a top bracket 15, a central carriage bracket 17 and a bottom bracket 19. These brackets and the other components may be made from metal, plastic, wood or other materials. The brackets 15, 17 and 19 are connected by a plurality of rods. One pair 21 of rods are adjustably fastened to the top bracket 15 and central carriage bracket 17, and another pair 23 of rods adjustably fasten the carriage bracket 17 to the bottom bracket 19. Top bracket 15 includes a downward facing, negatively sloped canvas engaging surface 16 and bottom bracket 19 has an upward facing, positively sloped canvas engaging surface 20. A pressure knob 25 is located on the top bracket 15 and a second pressure knob 27 is mounted on the bottom bracket 19 so that, as shown in FIG. 1, a large oil canvas 29 is held between surfaces 16 and 20. Both pairs 21 and 23 of extension rods are extended to their maximum length to accommodate the large canvas 29. Both brackets 15 and 19 have angled surfaces, such as at a 30° angle, to hold objects more securely.

Figure 2:
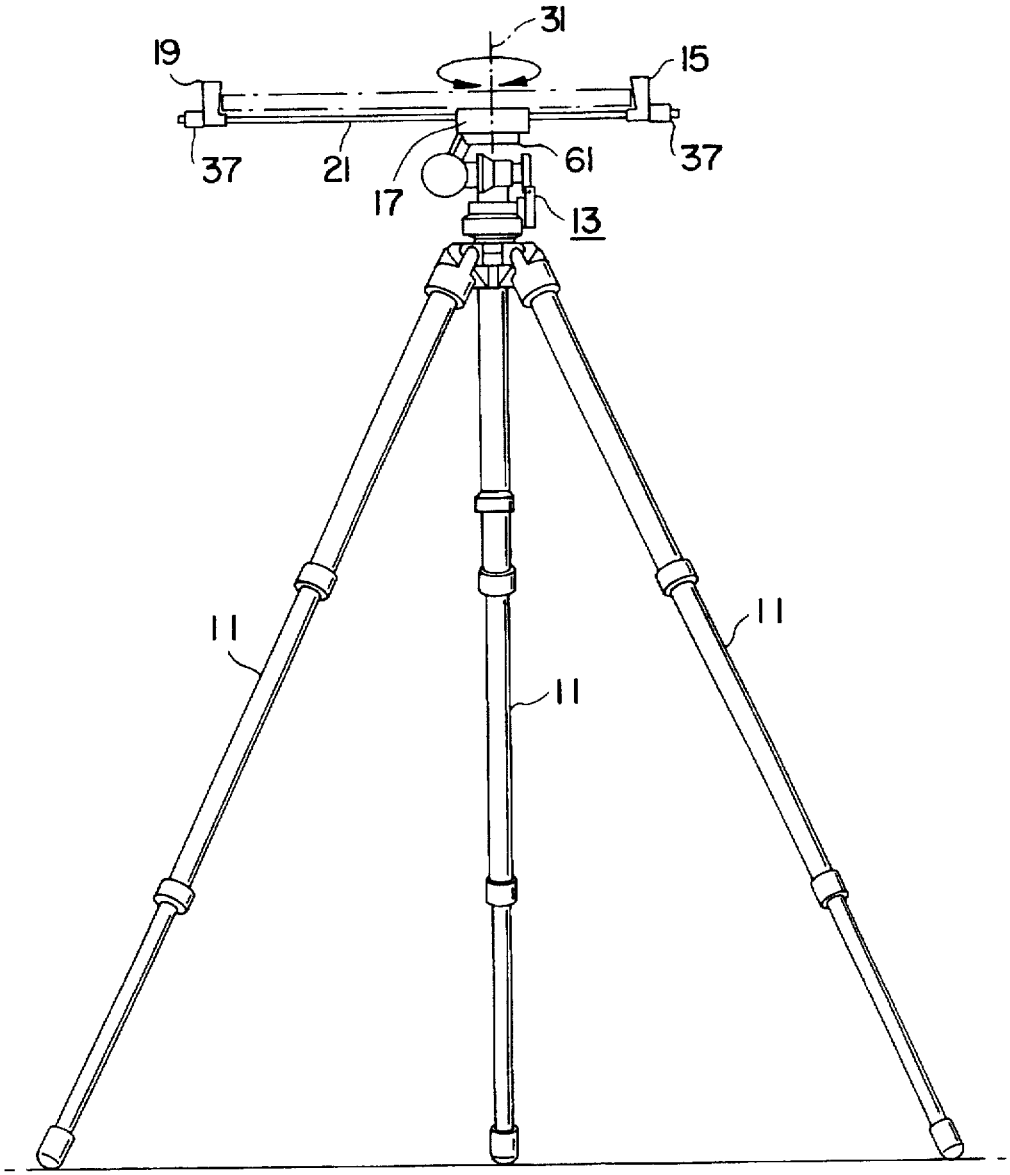
FIG. 2 is a view similar to FIG. 1 showing the clamping frame of the easel positioned in a watercolor mode.
Figure 3:
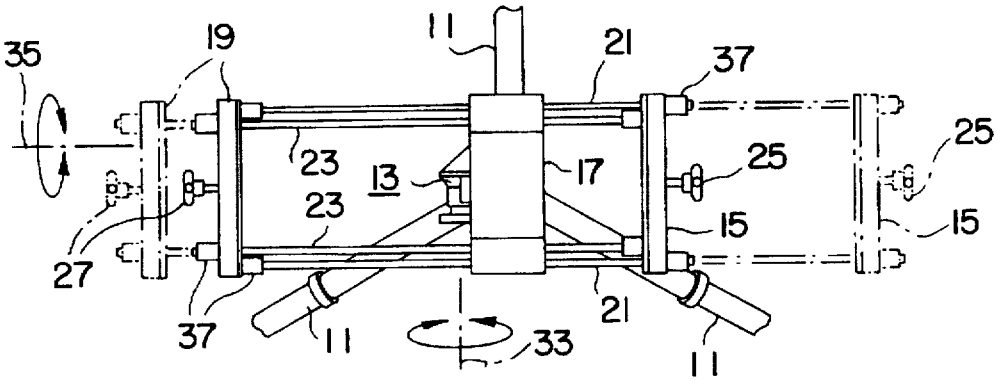
FIG. 3 is a fragmentary, plan view of FIG. 2, showing a plan view of the clamping frame in its retracted position in full line and in its most extended position by dot and dash line.

Canvas 29 may be positioned, as shown in FIG. 1 in an orientation suitable for oil painting, for example, and because the mounting bracket 13 is a universally positional head 13, the canvas may be re-oriented as desired. FIGS. 2 and 3 illustrates the easel repositioned to a horizontal orientation for a water colorist is use, and rotatable about all three axes of rotation for the water soaking of the paper such that axis 31 is the y axis, 33 is the z axis and 35 is the x axis. FIG. 3 illustrates how the work surface 29 may be tilted with respect to the horizon by movement about horizontal axis 33 and third axis 35, again merely by use of conventional adjustment knobs on the universal mounting element 13.

Figure 4:
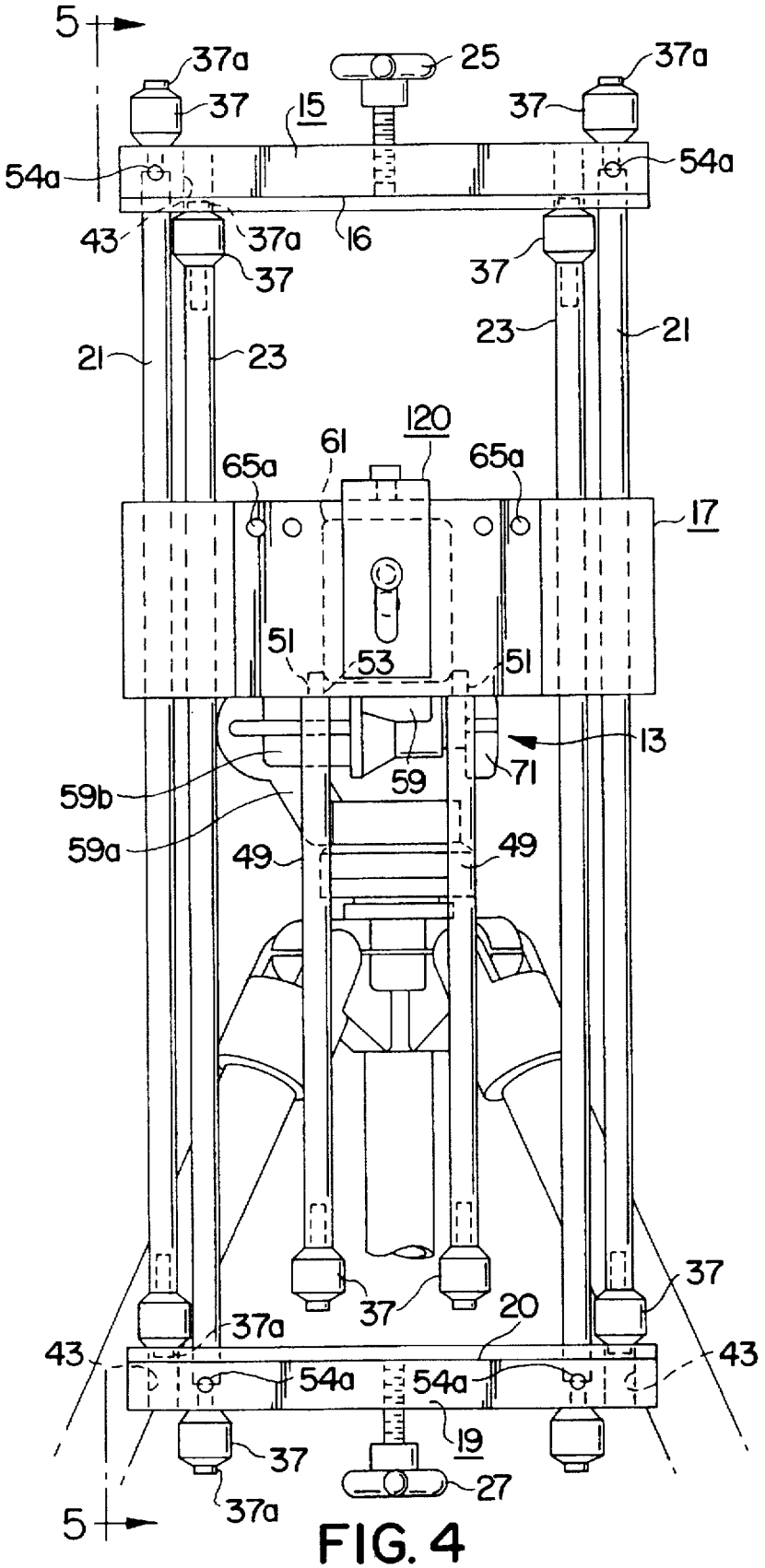
FIG. 4 is a greatly enlarged, fragmentary front elevational view of the clamping frame attached to the universally positional mounting plate of the tripod.
Figure 6:
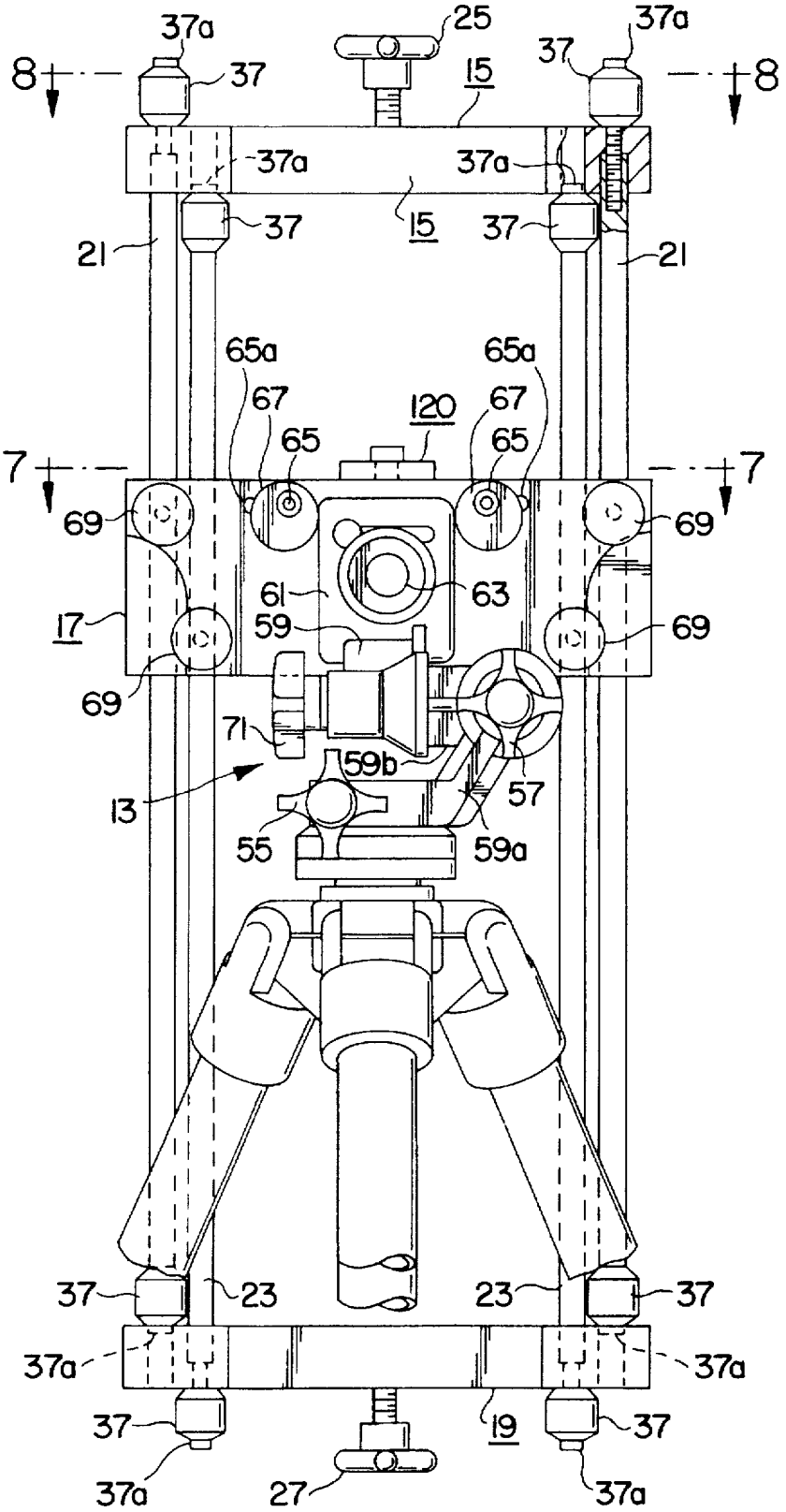
FIG. 6 is a fragmentary, rear elevational view of the clamping frame and universally positional mounting plate of the tripod, taken along the line 6,6 of FIG. 5.

FIGS. 4 and 6 illustrate the means by which the various pairs of extension rods are assembled in the easel of this invention. Thumb screws 37 anchor extension rods 21 to block 15. Similarly, thumb screws 37 also anchor extension rods 23 to block 19. The free ends of the extension rods 21 and 23 are capped by decorative thumb screws 37. As shown in FIGS. 4 and 6, thumb screws 37 engage bores 43 in brackets 19 and 15 respectively to solidly support and align the pairs 21 and 23 of extension rods when in the fully retracted or travel mode, providing a rigid structure that is compact and easy to carry or store. In addition, at least one extra pair 49 of extension rods are carried in carrier bracket 17 via threaded holes 51 into which the threaded ends 53 of the extension rods 49 are screwed.

Figure 5:
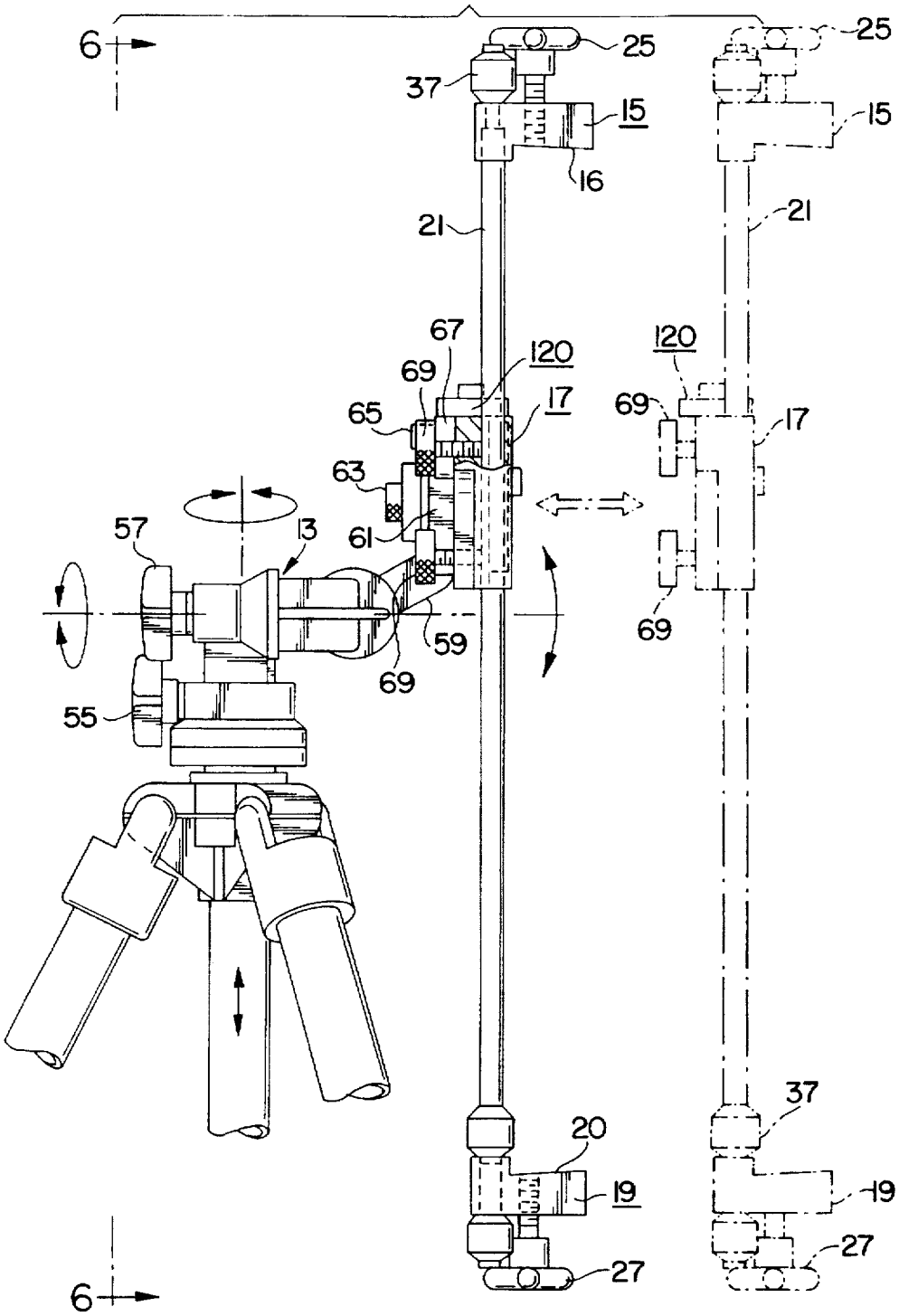
FIG. 5 is a fragmentary, side elevational view taken along the line 5,5 of FIG. 4 showing additional details of the clamping frame attached to the universally positionable mounting plate of the tripod, shown in full line, and a side elevational view of the clamping frame, removed from the mounting plate of the tripod and shown in dot and dash line.

The mechanism for attaching the central carriage bracket 17 to the mounting element 13 of the tripod is shown in FIGS. 4–7, such that in FIG. 5 the solid lines illustrate the bracket 17 and assembly attached and the dot and dash lines illustrate the bracket 17 and assembly separated from the tripod mounting element 13. The orientation of the mounting element 13 may be adjusted, as previously noted, by adjustment of adjustment knobs 55 and 57 for two of the axes of orientation. Adjustment knob 71 is shown in FIG. 6 for adjustment in the third axis.

Figure 7:
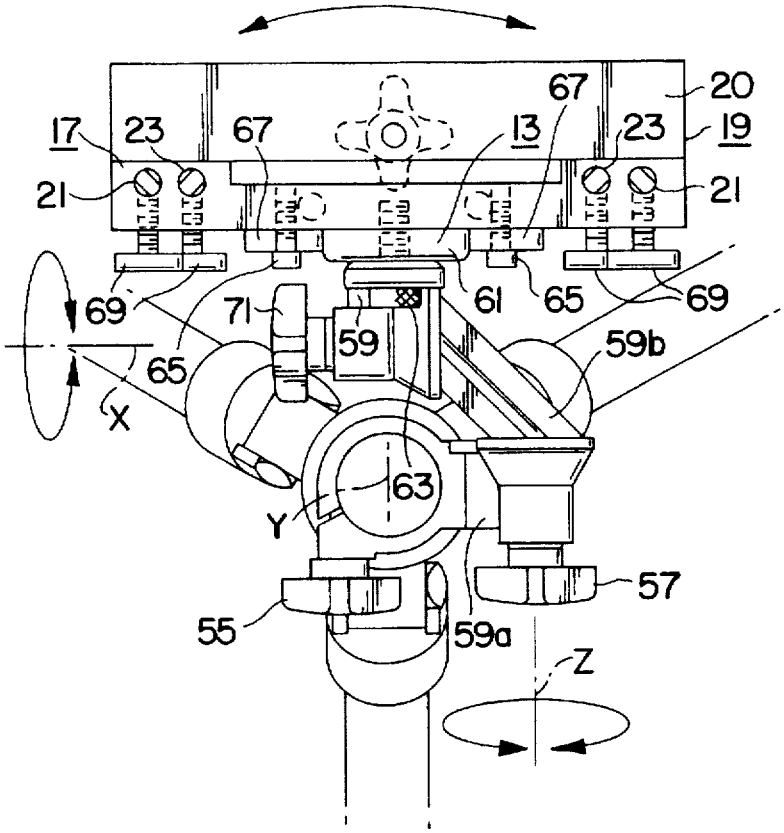
FIG. 7 is a sectional, plan view taken along the line 7,7 of FIG. 6, showing additional details of the universally positionable tripod mounting plate attached to the carriage block of the clamping frame.

As shown in FIGS. 4–7, angled bracket 59 extends from mounting element 13 bracket 59 which supports a rectangular mounting plate 61. Thumb screw 63 is threaded into carriage bracket 17 to mount bracket 17. In addition, machine screws 65 also attach eccentrically oriented locking disks 67 for additional support to bracket 61, as can be seen in FIG. 6. Disks 67 are eccentric about machine screws 65 so as to permit disks 67 to rotate into supporting engagement with bracket 61 to prevent rotation of the clamping frame about the mounting screw 63. The assembly is further stabilized by thumb screws 69 which engage pairs 21 and 23 of the extension rods that are joined to lock blocks 15 and 19 in a desired position. Also shown in FIG. 6 and 7 are angled brackets 59*a* and 59*b*, which form part of mounting element 13 as does previously described angle bracket 59. This design for the tripod mounting element allows for totally flexible orientation of the carrier bracket and thus any canvas or other planar object carried by the easel assembly. The discs 67 are eccentrically mounted to accommodate mounting plates 61 of various widths. Also, two additional threaded holes 65*a* are provided in block 17 to provide repositioning of the disc 67 in the event of extremely wide mounting plates 61.

As is also shown in FIGS. 4–6, an adjustable "L" shaped bracket 120 may be bolted to the carriage bracket 17 and is used only in the event the tripod mounting plate 61 is of an extremely massive size and the eccentrically mounted anti-rotation disks 67 will not accommodate the large massive mounting plate. In this event, the disks 67 are removed, the screws on the plate 120 loosened and the "L" shaped plate is adjusted upward so that the rearwardly directed flange of the "L" shaped plate 120 overlies the upper edge of the massive mounting plate. The balls of the "L" shaped bracket 120 are then tightened to again lock the clamping frame against rotation about the mounting screw 63.

Figure 8:
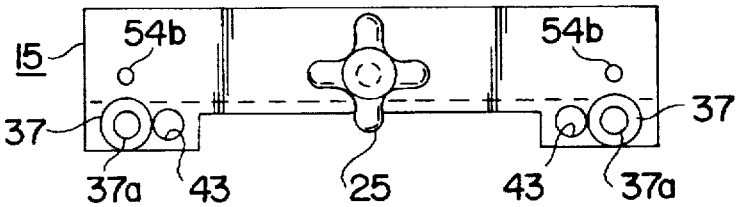
FIG. 8 is a plan view taken along the line 8,8 of FIG. 6, showing additional details of the upper clamping bar, the lower clamping bar being identical.
Figure 9:
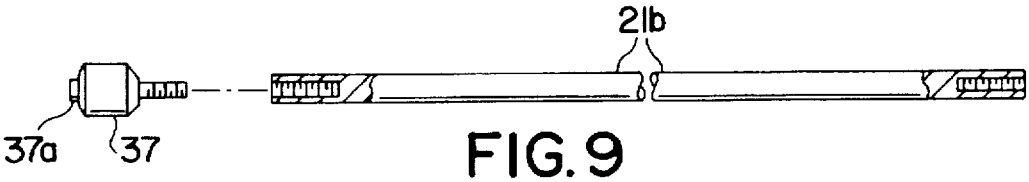
FIG. 9 is an exploded view of a typical cylindrical rod having threaded bores at each terminal end and a typical fastener utilized in the clamping frame assembly.

FIG. 7 illustrates further details of the universal mounting element 13 and its rectangular mounting bracket 61, as it is embraced by antirotation eccentric locking disks 67. The partial sectioning of this view illustrates the engagement of the various thumb screws 63,65 and 69. FIG. 8 shows the upper bracket 15 in isolation, illustrating the thumb screws 37 and seating bores 43 for the pair of extension rods 23 and their decorative thumb screws 37, those having cylindrical tops 37*a* which seat in bores 43 in a storage mode. FIG. 9 is an exploded view of a typical rod 21*b* and thumb screw 37. Also shown is the upper working piece clamping screw where two additional threaded holes are provided for positioning of the water colorist tray support rods.

Figure 10:
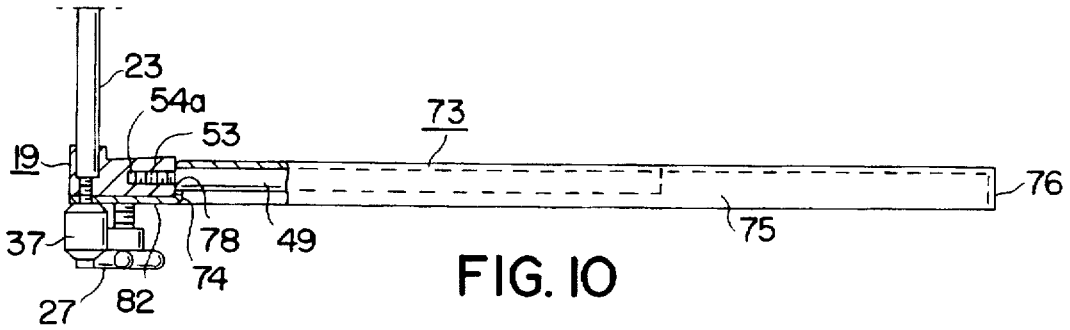
FIG. 10 is a fragmentary, side elevational view showing the lower clamping bar of the clamping frame supporting a palette and brush, detachable shelf, when in the oil painting mode of FIG. 1.
Figure 11:
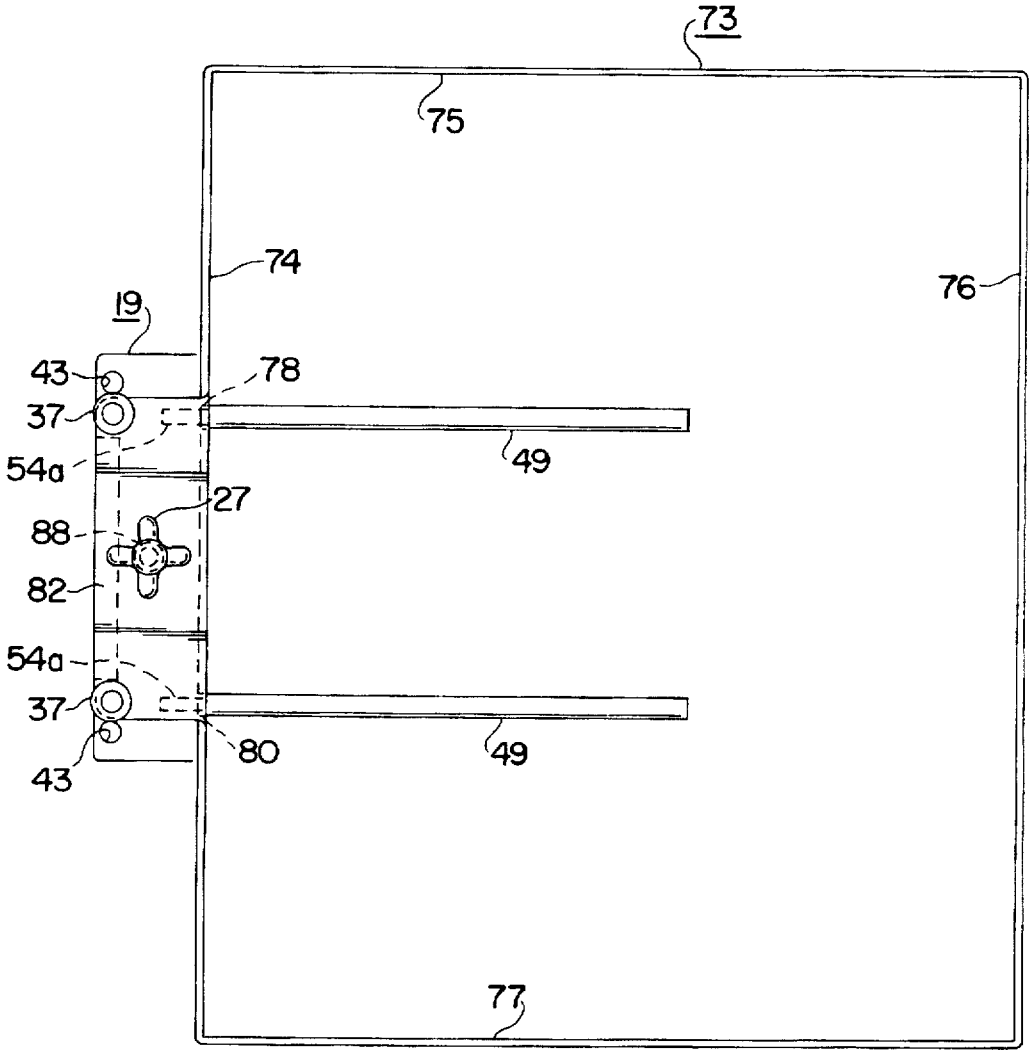
FIG. 11 is a bottom plan view of the clamping bar shown in FIG. 10, showing additional details of construction.

FIGS. 10 and 11 illustrate a pallet and brush shelf that is made from plastic or metal as desired. The operation and use is as follows. Rods 49 are unscrewed from the carriage block 17 and the threaded ends 53 of rods 49 are screwed into holes 54*a* in block 19. In this instance, as block 19 is the lower block in this embodiment, thumb screws 37 are removed. Also provided is a shelf 73 having four downwardly directed sides 74, 75, 76 and 77 to add rigidity to the assembly. Side 74 includes two holes 78 and 80 having a rearwardly directed horizontal tang 82 also having two holes 84 and 86 and one enlarged hole 88 in the center.

Shelf 73, with side 74 and holes 78 and 80, is aligned with the terminal ends of rods 49. Shelf 73 is slid on to the rods 49 until the side 74 abuts the front wall of bracket 19. Note that thumb screws 37 of rods 23 have been removed as has screw 27. In this position, tang 82 lies adjacent the bottom side of block 19 with holes axially aligned with the extension rod mounting holes in the block 19. Thumb screws 37 are then replaced, securing the shelf 73 to the clamping frame and the pressure screw 27 is then replaced. In this embodiment pressure screw 27 can not be used as a retaining screw.

Figure 12:
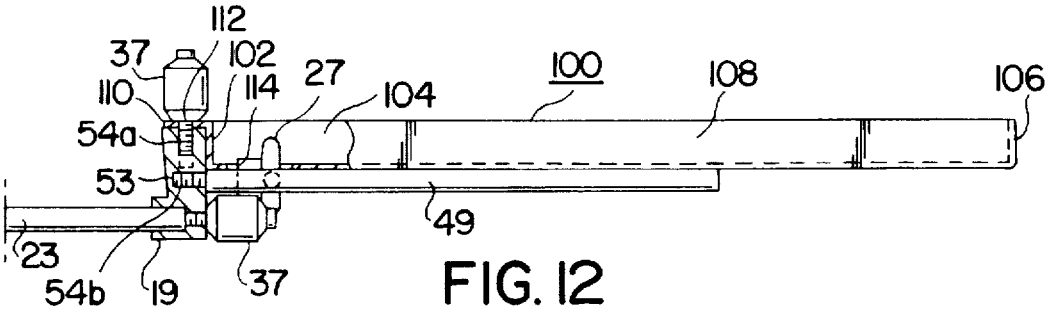
FIG. 12 is a fragmentary, side elevational view of the bottom clamping bar when the clamping frame has been rotated to the watercolor painting mode, shown if FIG. 2, supporting a detachable tray for a painting tray and brushes.
Figure 13:
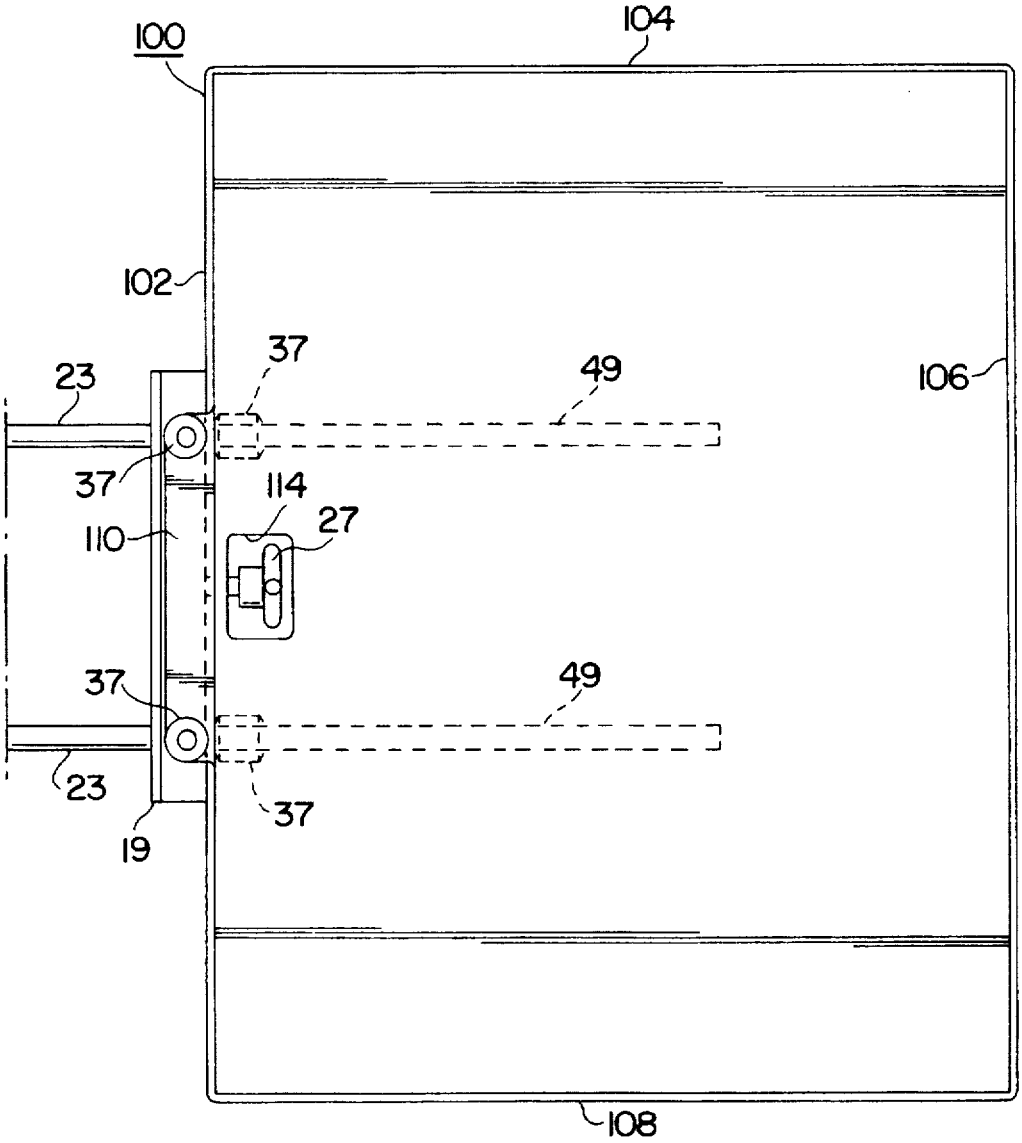
FIG. 13 is a bottom plan view of the clamping bar shown in FIG. 12, showing additional details of construction.

FIGS. 12 and 13 illustrate the use of tray 100 with the water colorist mode. Note that the clamping tray assembly previously described has been rotated to the horizontal orientation for water color work. Rods 49 are unscrewed from the underside of carriage block 17 and decorative thumb screws 37 have been removed from the ends of rods 49. Rods 49 are now screwed into threaded holes 54*b* on the bottom face of block 19. The water color try 100 has upstanding side walls 102, 104, 106 and 108 to hold paint boxes, brushes and the like. Side wall 102 has a centrally located horizontally extending tang 110 that includes two holes 112 that index with threaded holes 54*a* on block 19. Tray 100 is placed on top of support rods 49 and holes 112 on the tang 110 are indexed with the threaded holes 54*a* on block 19. Two decorative fasteners 37 are then used to secure the tray 100 to block 19. Finally it can be seen that cutout 114 in the tray bottom allows activation of pressure screw 27.

While particular embodiments of the present invention have been illustrated and described herein, it is not intended to limit the invention. Changes and modifications may be made herein without departing from the scope of the following claims:

What is claimed is:

1. An easel mounting device for mounting and supporting an artist's work surface such as a board or canvas or the like, the easel mounting device comprising:

a support structure having a plurality of adjustable legs, a frame assembly defining a work surface support plane, a mounting mechanism mounting the frame assembly on the support structure, the mounting mechanism including a carriage bracket and means connecting the carriage bracket to the support structure in a manner permitting universal pivoting movement of the frame assembly relative to the support structure, said carriage bracket comprising a top surface, a bottom surface, a first pair of parallel elongated bores extending through the carriage bracket from the top surface of the carriage bracket to the bottom surface of the carriage bracket, and a second pair of parallel elongated bores extending through the carriage bracket from the top surface of the carriage bracket to the bottom surface of the carriage bracket, said frame assembly including an elongated top bracket, an elongated bottom bracket oriented parallel to the elongated top bracket, and a means for adjusting the top bracket and the bottom bracket permitting a yawing movement of the frame assembly such that the top bracket and the bottom bracket remain parallel with respect to one another while moving relative to one another to accommodate work surfaces of different sizes, said means for adjusting the top bracket and the bottom bracket relative to one another comprising a first pair of elongated extension rods and a second pair of elongated extension rods, the first and second pair of elongated extension rods each having an elongated axis parallel to the work surface support plane, the first pair of elongated extension rods being attached to the top bracket and adjustably fastened to the carriage bracket and slidably received in the first pair of parallel elongated bores in the carriage bracket, the second pair of elongated extension rods being attached to the bottom bracket and adjustably fastened to the carriage bracket and slidably received in the second pair of parallel elongated bores in the carriage bracket, and at least one pair of shelf support rods removably mounted on a face of the bottom bracket and extending away from the work surface support plane for supporting a palette and brush shelf, each of the at least one pair of shelf support rods having an elongated axis, the carriage bracket having a means for mounting the shelf support rods, such that the at least one pair of shelf support rods may be removed from the bottom bracket and mounted to the means for mounting on the carriage bracket with the elongated axis of each of the at least one pair of shelf support rods oriented generally parallel to the elongated axis of each of the elongated extension rods, thereby allowing compact storage of the at least one pair of shelf support rods.

2. The easel mounting device as claimed in claim 1 including pressure nobs threadably engaging in said top and bottom brackets selectively adjustable relative to the bracket to engage and lock a work piece in position in the frame assembly.

3. The easel mounting device as claimed in claim 1 wherein said elongated top bracket includes a bottom surface forming a first acute angle with the work surface support plane, said elongated bottom bracket includes a top surface forming a second acute angle with the work surface support plane, the top surface of the elongated bottom bracket faces the bottom surface of the elongated top bracket and the first acute angle faces the second acute angle, such that the top surface of the elongated bottom bracket and the bottom surface of the elongated top bracket are capable of engaging opposing sides of the work surface and the carriage bracket is capable of engaging an undersurface of the work surface.

* * * * *